US009366250B1

(12) United States Patent
Takeda et al.

(10) Patent No.: US 9,366,250 B1
(45) Date of Patent: Jun. 14, 2016

(54) HYDRAULIC DEVICE

(71) Applicants: Hiroaki Takeda, Hyogo (JP); Tetsuro Hosokawa, Hyogo (JP)

(72) Inventors: Hiroaki Takeda, Hyogo (JP); Tetsuro Hosokawa, Hyogo (JP)

(73) Assignee: SUMITOMO Precision Products Co., Ltd., Hyogo (JP)

( * ) Notice: Subject to any disclaimer, the term of this patent is extended or adjusted under 35 U.S.C. 154(b) by 221 days.

(21) Appl. No.: 14/360,885

(22) PCT Filed: Jun. 27, 2013

(86) PCT No.: PCT/JP2013/067635

§ 371 (c)(1),
(2) Date: May 27, 2014

(87) PCT Pub. No.: WO2014/207860

PCT Pub. Date: Dec. 31, 2014

(51) Int. Cl.
*F04C 2/18* (2006.01)
*F04C 15/00* (2006.01)
*F04C 2/08* (2006.01)

(52) U.S. Cl.
CPC . *F04C 2/18* (2013.01); *F04C 2/084* (2013.01); *F04C 15/0042* (2013.01); *F04C 2/086* (2013.01); *F04C 15/0026* (2013.01); *F04C 2240/52* (2013.01); *Y10T 74/19953* (2015.01)

(58) Field of Classification Search
CPC ..... Y10T 74/19953; F04C 2/18; F04C 2/16; F04C 2/086; F04C 2/084; F04C 15/0026; F04C 15/0042; F04C 15/0046; F04C 15/0049; F04C 29/0021; F04C 29/0028; F04C 29/0035; F04C 2250/20; F04C 2240/52; F04C 2240/20; F04C 2240/30; F04C 27/006; F04C 2270/044; F04C 2270/0445; F04C 18/16; F04C 18/18
See application file for complete search history.

(56) References Cited

U.S. PATENT DOCUMENTS 3,658,452 A * 4/1972 Kita ..... F04C 15/0042 415/104
4,276,785 A * 7/1981 Rouverol ..... F16H 55/0806 74/457
5,028,221 A 7/1991 Malfit
5,447,421 A * 9/1995 Malfit ..... F04C 15/0042 418/132
6,769,891 B2 8/2004 Morselli
6,887,055 B2 * 5/2005 Morselli ..... F04C 15/0042 418/132

(Continued)

FOREIGN PATENT DOCUMENTS

EP 0165884 A1 12/1985
EP 0769104 B1 1/1999

(Continued)

OTHER PUBLICATIONS

Written Opinion of the International Searching Authority for related International Application No. PCT/JP2013/067635; report dated Aug. 10, 2013.

*Primary Examiner* — Thomas Denion
*Assistant Examiner* — Xiaoting Hu
(74) *Attorney, Agent, or Firm* — Miller, Matthias & Hull LLP

(57) ABSTRACT

A hydraulic device includes a cover plate with a cylinder hole opposite an end surface of a rotating shaft of a gear which receives two thrust forces in the same direction. A piston extends through the cylinder hole. A working liquid in a high pressure side acts on a back surface of the piston to press the piston onto the end surface of the rotating shaft, thereby causing a drag that cancels the two thrust forces acting on the gear.

4 Claims, 11 Drawing Sheets

(56) References Cited

U.S. PATENT DOCUMENTS

| | | | | |
|---|---|---|---|---|
| 8,556,609 | B2 | 10/2013 | Morselli | |
| 2009/0311120 | A1 | 12/2009 | Okada | |
| 2011/0223051 | A1* | 9/2011 | Giuseppe | F04C 2/16 418/206.5 |
| 2012/0114514 | A1* | 5/2012 | Laetzel | F04C 2/18 418/201.1 |
| 2012/0156080 | A1* | 6/2012 | Laetzel | F04C 2/16 418/206.5 |

FOREIGN PATENT DOCUMENTS

| | | | |
|---|---|---|---|
| EP | 2406497 | A2 | 1/2012 |
| FR | 2564931 | A1 | 11/1985 |
| JP | 4716424 | | 6/1972 |
| JP | 02095789 | | 6/1990 |
| JP | 0631621 | B2 | 4/1994 |
| JP | 4829957 | B2 | 12/2011 |
| JP | 2012519798 | A | 8/2012 |
| WO | 8705957 | A1 | 10/1987 |
| WO | 2010102722 | A2 | 9/2010 |

* cited by examiner

HYDRAULIC DEVICE

CROSS-REFERENCE TO RELATED APPLICATIONS

This application is a U.S. National Stage filing under 35 USC §371 of International Patent Application No. PCT/JP2013/067635 filed on Jun, 27, 2013.

FIELD OF THE DISCLOSURE

The present invention relates to a hydraulic device having a pair of gears whose tooth surfaces mesh with each other, and specifically relates to a hydraulic device using, as the pair of gears, helical gears which have a tooth profile including an arc portion at a tooth tip and a tooth root, and which form a continuous line of contact from one end portion to the other end portion in a face width direction at a meshing portion.

BACKGROUND OF THE DISCLOSURE

Hydraulic devices as mentioned above include a hydraulic pump which rotates a pair of gears by an appropriate drive motor and pressurizes a working liquid by the rotational motions of the gears and discharges the pressurized working liquid, and a hydraulic motor which rotates gears by introducing a previously pressurized working liquid therein and uses rotational forces of rotating shafts of the gears as a power.

Such a hydraulic device generally has a configuration in which a pair of gears meshing with each other are contained in a housing and rotating shafts extended outward from both end surfaces of each gear are rotatably supported by bearing members which are contained in the same housing and disposed on both sides of each gear.

Conventionally, gears of various shapes have been used as the pair of gears and some hydraulic devices use helical gears as the pair of gears. Helical gears have a characteristic that, because of having a structure in which their teeth are oblique, gear tooth contact is spread and therefore noise is small, whereas they have a characteristic that, in a case where they are used as a hydraulic device, an axial force (thrust force) is generated by meshing of their teeth and further a thrust force is similarly generated by the fact that their tooth surfaces receive a pressure of the working liquid.

These thrust forces periodically vary due to rotations of the gears and such periodic variation causes a problem that noise is generated by vibration of the gears and the bearing members, or a problem that a gap is formed between the end surfaces of the gears and the end surfaces of the bearing members by the vibration and leakage from the high-pressure side to the low-pressure side through the gap is caused.

Accordingly, for solving these problems, there has been suggested a hydraulic device (specifically, a gear pump) configured to inhibit displacement of the gears in their axial directions by causing a force in the opposite direction (drag) greater than the above-described thrust forces to act on the rotating shafts (see the U.S. Pat. No. 6,887,055 (PTL 1)). A configuration of the gear pump described in the PTL 1 is shown in FIG. 17.

As shown in FIG. 17, a gear pump 100 has a body 101 having a hydraulic chamber 101*a* formed therein, and a pair of helical gears 115, 120 inserted in the hydraulic chamber 101*a* with their tooth portions meshing with each other. As for the pair of gears 115, 120, the gear 115 is a driving gear and the gear 120 is a driven gear, and their rotating shafts 116, 121 are rotatably supported by bushes 110*a*, 110*b*, 110*c* and 110*d* which are similarly inserted in the hydraulic chamber 101*a*.

Further, a front cover 102 is liquid-tightly fixed to the front end surface of the body 101 by a seal, while an intermediate plate 106 is similarly liquid-tightly fixed to the rear end surface of the body 101 by a seal and a rear cover 104 is similarly liquid-tightly fixed to the rear end surface of the intermediate plate 106 by a seal. The body 101, the front cover 102, the intermediate plate 106 and the rear cover 104 together form a housing within which the hydraulic chamber 101*a* is sealed. It is noted that the rotating shaft 116, which is inserted through a through hole 102*a* of the front cover 102 and extended outward, is sealed by a not-shown seal between the outer peripheral surface of the rotating shaft 116 and the inner peripheral surface of the through hole 102*a*.

The hydraulic chamber 101*a* is divided in two, a high-pressure side and a low-pressure side, at a meshing portion of the pair of gears 115, 120, and when the driving gear 115 is driven and rotated by an appropriate driving source and the pair of gears 115, 120 thereby rotate, a working liquid is introduced into the low pressure side through a not-shown intake port and the introduced working liquid is led to the high pressure side while being pressurized by an action of the pair of gears 115, 120, and the high-pressure working liquid is discharged through a not-shown discharge port.

Further, the intermediate plate 106 has through holes 106*a*, 106*b* bored therethrough at portions corresponding to the rotating shafts 116, 121, respectively, and pistons 108, 109 are inserted through the through holes 106*a*, 106*b*, respectively. Further, a concave hydraulic chamber 104*a* corresponding to a region including the through holes 106*a*, 106*b* is formed in the surface being in contact with the intermediate plate 106 (front surface) of the rear cover 104, and the working liquid in the high-pressure side is to be supplied into the hydraulic chamber 104*a* through an appropriate flow path. Furthermore, the working liquid in the high-pressure side is to be supplied into between the front surface of the intermediate plate 106 and the rear surfaces of the bushes 110*a*, 110*c* through an appropriate flow path.

According to the gear pump 100 having the above-described configuration, during the operation of the gear pump 100, the working liquid in the high-pressure side is supplied into the hydraulic chamber 104*a* of the rear cover 104, the pistons 108, 109 are pressed forward by the high-pressure working liquid, and the gears 115, 120 are pressed forward by the pistons 108, 109 via the rotating shafts 116, 121, and simultaneously the bushes 110*a*, 110*c* are pressed forward by the high-pressure working liquid supplied into between the front surface of the intermediate plate 106 and the rear surfaces of the bushes 110*a*, 110*c*. Due to these actions, the bushes 110*a*, 110*c*, the gears 115, 120 and the bushes 110*b*, 110*d* are integrally pressed forward and the bushes 110*b*, 110*d* are pressed onto the rear end surface of the front cover 102.

It is noted that the pressing force for integrally pressing a structure comprising the bushes 110*a*, 110*b*, the gears 115, 120 and the bushes 110*b*, 110*d* forward is set to be greater than the thrust forces generated by the rotations of the gears 115, 120. Further, the pistons 108, 109 have their respective pressure receiving areas (cross-sectional areas) which are respectively determined in accordance with the thrust forces acting on the driving gear 115 and the driven gear 120, and the cross-sectional area of the piston 108 is larger than that of the piston 109.

As described above, in a hydraulic device using helical gears, the thrust forces generated by rotations of the helical gears causes vibration and noise and causes leakage from the high pressure side to the low pressure side. However, according to the gear pump 100, since the structure comprising the bushes 110*a*, 110*c*, the gears 115, 120 and the bushes 110*b*, 110*d* is pressed onto the rear end surface of the front cover 102 by integrally pressing them forward with a force greater than the thrust forces, the gears 115, 120 and the bushes 110*a*, 110*b*, 110*c*, 110*d* do not vibrate and the occurrence of the above-described noise and leakage problems caused by vibration is prevented.

It is noted that as a gear pump using helical gears, besides the gear pump as disclosed in the PTL 1, conventionally, there have been known a gear pump as disclosed in the Japanese Unexamined Patent Application Publication No. H2-95789 (PTL 2) and a gear pump as disclosed in the Japanese Examined Utility Model Application Publication No. S47-16424 (PTL 3).

In the gear pump disclosed in the PTL 2, the pressure of the fluid to be driven is caused to act on the shaft end surface opposite the output side of the driving gear to cause a thrust force acting on the driving shaft due to this pressure and the thrust force acting on the driving shaft due to meshing of the gears to cancel each other out.

Further, in the gear pump disclosed in the PTL 3, similarly to the gear pump disclosed in the PTL 1, a thrust force due to a pressure fluid is caused to act on each of the shaft ends of the driving gear and the driven gear to cause these thrust forces and the thrust forces acting on the driving gear and the driven gear to cancel each other out.

SUMMARY OF THE DISCLOSURE

However, the above-described conventional gear pumps have a problem as described below. That is, first, in the gear pump 100 described in the PTL 1, although the noise and leakage problems caused by vibration are prevented, there is a problem that, because the gear pump 100 is configured to always integrally press the structure comprising the bushes 110*a*, 110*c*, the gears 115, 120 and the bushes 110*b*, 110*d* forward with a force greater than the thrust forces and thereby press it onto the rear end surface of the front cover 102, the end surfaces of the bushes 110*a*, 110*b*, 110*c* and 110*d* are always in sliding contact with the end surfaces of the gears 115, 120 with a considerable pressure, and thereby burn occurs on the end surfaces of the bushes 110*a*, 110*b*, 110*c*, 110*d*. Further, if such a state continues for a long time, finally the end surfaces of the bushes 110*a*, 110*b*, 110*c*, 110*d* are damaged and this results in the occurrence of noise and leakage from the damaged portions, and further, the worst situation that the gears 115, 120, the bushes 110*a*, 110*b*, 110*c*, 110*d*, the body 101 and the like are broken can occur.

Further, although the gear pump disclosed in the PTL 2 is configured to cause a hydraulic pressure to act on only a shaft end of the driving shaft and thereby apply a thrust force corresponding to the hydraulic pressure to the driving shaft, this thrust force opposes the thrust force generated by meshing of the driving gear and the driven gear, and, in this gear pump, the thrust force generated by hydraulic pressures acting on the driving gear and the driven gear are not taken into consideration at all. Therefore, in this gear pump, a periodically varying thrust force cannot be reduced and it is not possible to appropriately maintain a contact pressure between the end surfaces of the helical gears and the members in contact therewith. Therefore, the problem of the occurrence of noise and leakage is not solved. Further, the PTL 2 only discloses that a thrust force as drag is caused to act on the driving shaft, and therefore the specific magnitude of drag that should be caused to act on the driving shaft is not clear at all.

On the other hand, the PTL 3 discloses the specific magnitudes of the two thrust forces acting on the helical gears, that is, the thrust force generated by meshing and the thrust force generated by a hydraulic pressure. However, according to knowledge obtained as a result of eager studies by the inventors, it was found out that, in a case of using helical gears which have a tooth profile including an arc portion at a tooth tip and a tooth root and forming a continuous line of contact from one end portion to the other end portion in a face width direction at a meshing portion, the thrust forces acting on them have magnitudes different from those disclosed in the PTL 3. Therefore, in a case of using helical gears having such a tooth profile, even if thrust forces as disclosed in the PTL 3 are caused to act on the rotating shafts, a periodically varying thrust force cannot be reduced and it is not possible to appropriately maintain a contact pressure between the end surfaces of the helical gears and the members in contact therewith, and therefore the problem of the occurrence of noise and leakage cannot be solved.

Further, in the gear pumps disclosed in the PTLs 1 to 3, mechanical efficiency is not taken into consideration at all, and, in the case where mechanical efficiency is not taken into consideration, it is not possible to exactly cancel the thrust forces acting on the helical gears and the above-described problems are not completely solved.

Furthermore, the inventors, as a result of their eager studies, obtained knowledge that, in the case of using the above-described helical gears, that is, helical gears which have a tooth profile including an arc portion at a tooth tip and a tooth root and forming a continuous line of contact from one end portion to the other end portion in a face width direction at a meshing portion, there can be a case where no thrust force acts on the driven gear.

The present invention has been achieved in view of the above-described circumstances and an object thereof is to provide a hydraulic device using helical gears which have a tooth profile including an arc portion at a tooth tip and a tooth root and forming a continuous line of contact from one end portion to the other end portion in a face width direction at a meshing portion and which is capable of reducing a periodically varying thrust force, appropriately maintaining a contact pressure between end surfaces of the helical gears and members in contact therewith and preferably maintaining tight contact between them, and effectively suppressing the occurrence of noise and leakage.

The present invention, for solving the above-described problem, relates to a hydraulic device comprising:

a pair of helical gears which each have a rotating shaft provided to extend outward from both end surfaces thereof, and whose tooth portions mesh with each other, the pair of gears having a tooth profile including an arc portion at a tooth tip and a tooth root, and forming a continuous line of contact from one end portion to the other end portion in a face width direction at a meshing portion;

a body open at both ends and having a hydraulic chamber therein in which the pair of gears are contained in a state of meshing with each other, the hydraulic chamber having an arc-shaped inner peripheral surface with which outer surfaces of the tooth tips of the gears are in sliding contact;

a pair of bearing members which are respectively disposed on both sides of the gears in the hydraulic chamber of the body and which support the rotating shafts of the gears so that the rotating shafts are rotatable; and a pair of cover plates which are respectively liquid-tightly fixed to both end surfaces of the body to seal the hydraulic chamber, wherein the hydraulic chamber has a low-pressure side defined at one side of the meshing portion of the pair of gears and a high-pressure side defined at the other side thereof, and the body has a flow path which opens into the inner surface of the low-pressure side of the hydraulic chamber and a flow path which opens into the inner surface of the high-pressure side of the hydraulic chamber.

Further, the hydraulic device of the present invention has seal members with elasticity respectively interposed between facing surfaces of the pair of cover plates, which face the pair of bearing members, and facing surfaces of the pair of bearing members, which face the pair of cover plates, and dividing spaces between the facing surfaces of the pair of cover plates and the facing surfaces of the pair of the bearing members, and the hydraulic device is configured so that: the pair of bearing members are disposed to be in contact with the end surfaces of the gears; a working liquid in the high-pressure side is supplied into the spaces divided by the seal members between the facing surfaces of the pair of cover plates and the facing surfaces of the pair of bearing members; and the pair of gears and the pair of bearing members can be moved in axial directions of the rotating shafts by elastic deformation of the seal members.

Alternatively, the hydraulic device of the present invention has a pair of side plates which are respectively interposed between the pair of gears and the pair of bearing members and which are respectively disposed to be in contact with the end surfaces of the gears, and has seal members with elasticity respectively interposed between the pair of side plates and the pair of bearing members to divide spaces between facing surfaces of the pair side plates, which face the pair of bearing members, and facing surfaces of the pair of bearing members, which face the pair of side plates, and further, the hydraulic device is configured so that a working liquid in the high-pressure side is supplied into the spaces divided by the seal members between the facing surfaces of the pair side plates and the facing surfaces of the pair of bearing members and the pair of gears and the pair of side plates can be moved in axial directions of the rotating shafts by elastic deformation of the seal members.

Further, in the present invention, each of the above-described hydraulic devices has a configuration in which: one of the pair of cover plates which faces a shaft end surface of a thrust-force acting side of the rotating shaft of one of the gears which receives a thrust force due to the working liquid in the high-pressure and a thrust force due to the meshing from the same direction has a cylinder hole formed at a portion opposite to the shaft end surface thereof; a flow path for supplying the working liquid in the high-pressure side into the cylinder hole is formed; a piston is inserted through the cylinder hole to be capable of being brought into contact with the shaft end surface opposite to the cylinder hole; and the working liquid in the high-pressure side is caused to act on a back surface of the piston to press the piston onto the shaft end surface, thereby causing a drag approximately balancing a resultant force of the two thrust forces to act on the shaft end surface, whereas the one of the pair of cover plates does not have a cylinder hole formed at a portion opposite to a shaft end surface of the rotating shaft of the other of the pair of gears thereof.

As described above, in a hydraulic device using helical gears, a thrust force is generated due to meshing of the teeth (hereinafter, referred to as a "meshing thrust force"), and a thrust force is similarly generated due to the fact that the tooth surfaces receive a pressure of a working liquid (hereinafter, referred to as a "pressure receiving thrust force").

Of these thrust forces, the pressure receiving thrust force acts on the tooth surfaces of the pair of gears in the same manner, and therefore the directions of the pressure receiving thrust forces acting on the pair of gears are the same direction. On the other hand, since the meshing thrust force is generated due to meshing of the tooth portions of the pair of gears and the meshing thrust forces acting on the gears act as a reaction force to each other, the directions of the meshing thrust forces acting on the pair of gears are opposite directions. Therefore, the directions of the meshing thrust force and the pressure receiving thrust force acting on one gear of the pair of gears are the same and a thrust force as a resultant force of the meshing thrust force and the pressure receiving thrust force acts on the one gear. On the other hand, the directions of the meshing thrust force and the pressure receiving thrust force acting on the other gear of the pair of gears are opposite to each other, and a thrust force as a differential between the meshing thrust force and the pressure receiving thrust force acts on the other gear.

Further, according to knowledge of the inventors, in a case where each of the helical gears is a gear which has a tooth profile including an arc portion at a tooth tip and a tooth root and forming a continuous line of contact from one end portion to the other end portion in a face width direction at a meshing portion (hereinafter, such a helical gear is referred to as a "continuous-line-of-contact meshing gear"), and the tooth profile fulfills the condition that a ratio of contact ratios $\epsilon_r(=\epsilon_\beta/\epsilon_\alpha)$ which is the ratio of the overlap ratio $\epsilon_\beta$ to the transverse contact ratio $\epsilon_\alpha$ of the gears is $2 <= \epsilon_r <= 3$, there is a case where the meshing thrust force and the pressure receiving thrust force have the same magnitude, and it is possible to achieve a hydraulic device within a practical mechanical efficiency.

Thus, in the case where the meshing thrust force and the pressure receiving thrust force have the same magnitude, the pressure receiving thrust force and the meshing thrust force are cancelled out on the other gear and no thrust force acts thereon.

On the other hand, in the present invention, since, as described above, the piston is pressed onto the shaft end surface of the rotating shaft of the gear on which a resultant force of the meshing thrust force and the pressure receiving thrust force acts and thereby a drag having a magnitude which approximately balances the resultant force is caused to act on the shaft end surface of the rotating shaft by the piston, no thrust force acts also on the one gear.

Thus, in the hydraulic device of the present invention, it is possible to achieve a state where both of the pair of gears do not receive a thrust-directional force. Therefore, according to the present invention, there is not caused the above-described conventional problem that seizure or damage caused by a thrust force occurs on the bearing members or the side plates which are into sliding contact with the end surfaces of the pair of gears.

Further, in the hydraulic device of the present invention, since providing the piston for causing a reaction force to act on only the rotating shaft of one of the gears achieves the state where no thrust force acts on both of the gears, the above-described problem can be solved while reducing costs for manufacturing the hydraulic device.

Further, in a case where mechanical efficiency is not taken into consideration, it is preferred that the "continuous-line-of-contact meshing gear" has a tooth profile which fulfills the condition that the ratio of contact ratios $\epsilon_r$ is 2 or 3. According to knowledge of the inventors, in a case where it is assumed that an input value and an output value in the hydraulic device of the present invention are equal to each other, that is, mechanical efficiency is 100%, when the gears have a tooth profile which fulfills the condition that the ratio of contact ratios $\epsilon_r$ is 2 or 3, the hydraulic device is a hydraulic device having practical gears and it is possible to cause the meshing thrust force and the pressure receiving thrust force to have the same magnitude and therefore the above-described effect is obtained.

Further, in the present invention, since the working liquid in the high-pressure side is caused to act on the back surfaces of the bearing members or the side plates, which are into contact with both end surfaces of the pair of gears, to bring the bearing members or the side plates into tight contact with both end surfaces of the pair of gears, and the pair of gears and the bearing members or side plates which are brought into tight contact therewith are provided so that they can be moved in the axial directions of the rotating shafts by elastic deformation of the seal members, even if periodic variation occurs on the thrust forces or sudden vibration occurs on the hydraulic device, such variation and sudden vibration are absorbed by movement of the pair of gears and the bearing members or the side plates in the axial directions of the rotating shafts, and the occurrence of noise caused by such variation and vibration is suppressed. Further, since the bearing members or the side plates are brought into tight contact with both end surfaces of the gears by the working liquid in the high-pressure side which acts on the back surfaces thereof, leakage of the working liquid through the end surfaces of the gears is appropriately suppressed.

Further, it is preferred that the magnitude of the drag caused to act on the piston is within a range of 0.9 to 1.1 times of the resultant force, and this drag is determined in accordance with a pressure receiving area S ($mm^2$) of the piston and the pressure receiving area S ($mm^2$) of the piston is set so that a drag within the above-mentioned range is generated.

It is noted that the "continuous-line-of-contact meshing gear" in the present invention includes an involute gear, a sine-curve gear, a segmental gear, a parabolic gear, etc.

As described above, according to the present invention, in a hydraulic device using "continuous-line-of-contact meshing gears" as gears, the thrust forces acting on the gears can be reduced and the gears can be brought into a natural state. Therefore, according to the present invention, there is not caused the above-described conventional problem that seizure or damage caused by the thrust forces occurs on the bearing members or side plates being in sliding contact with both end surfaces of the pair of gears.

Further, even if periodic variation occurs on the thrust forces or sudden vibration occurs on the hydraulic device, such variation and sudden vibration can be absorbed by movement of the pair of gears and the bearing members or the side plates in the axial directions of the rotating shafts, and the occurrence of noise caused to such variation and vibration can be suppressed. Furthermore, since the bearing members or the side plates are brought into tight contact with both end surfaces of the gears by the working liquid in the high pressure side which acts on the back surfaces thereof, leakage of the working liquid through the end surfaces of the gears can be appropriately suppressed.

DETAILED DESCRIPTION

Hereinafter, a specific embodiment of the present invention will be described on the basis of the drawings. It is noted that the hydraulic device of this embodiment is an oil hydraulic pump and a hydraulic oil is used as working liquid.

Figure 1:
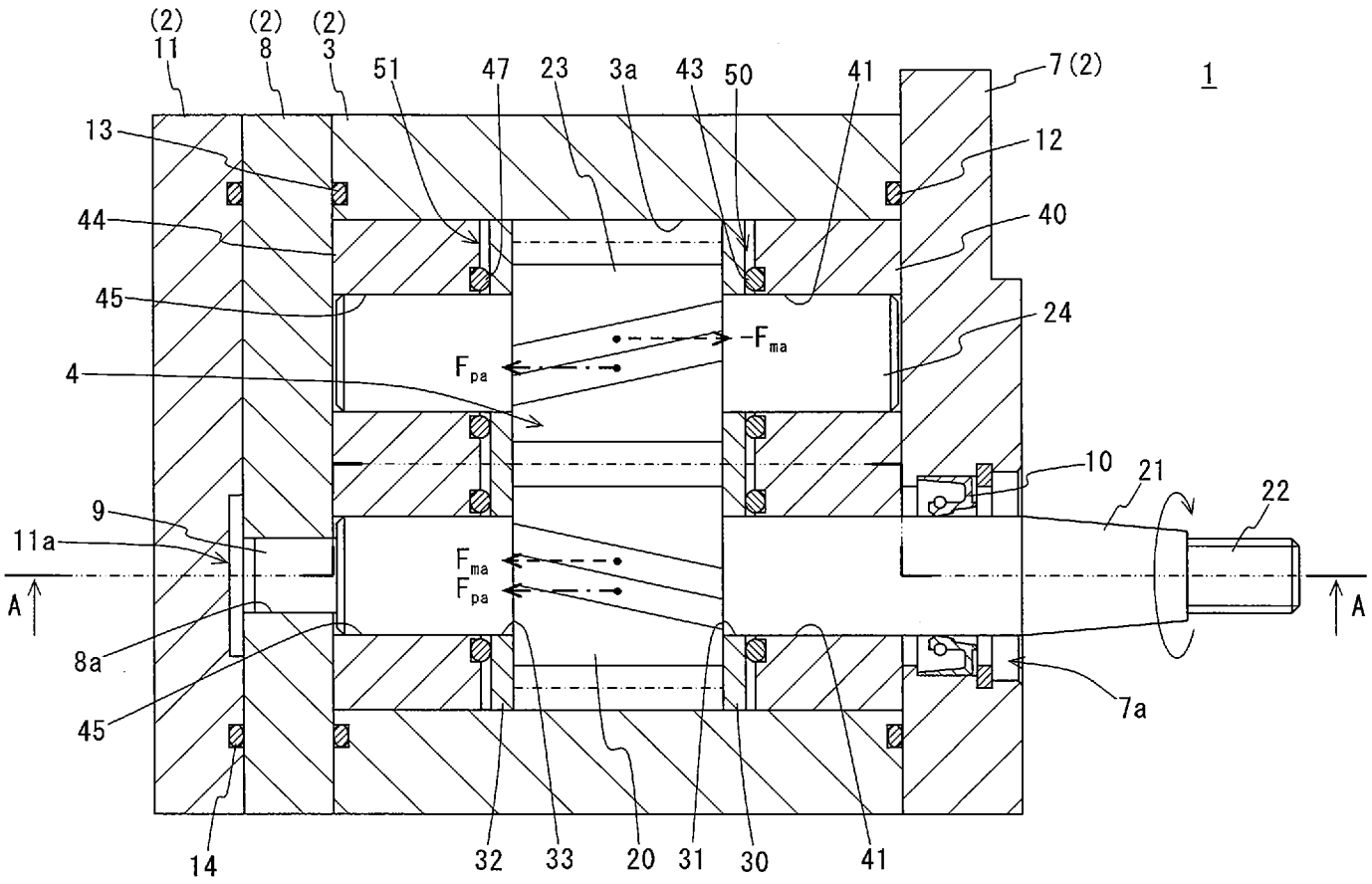
FIG. 1 is a plan sectional view of an oil hydraulic pump according to one embodiment of the present invention.
Figure 2:
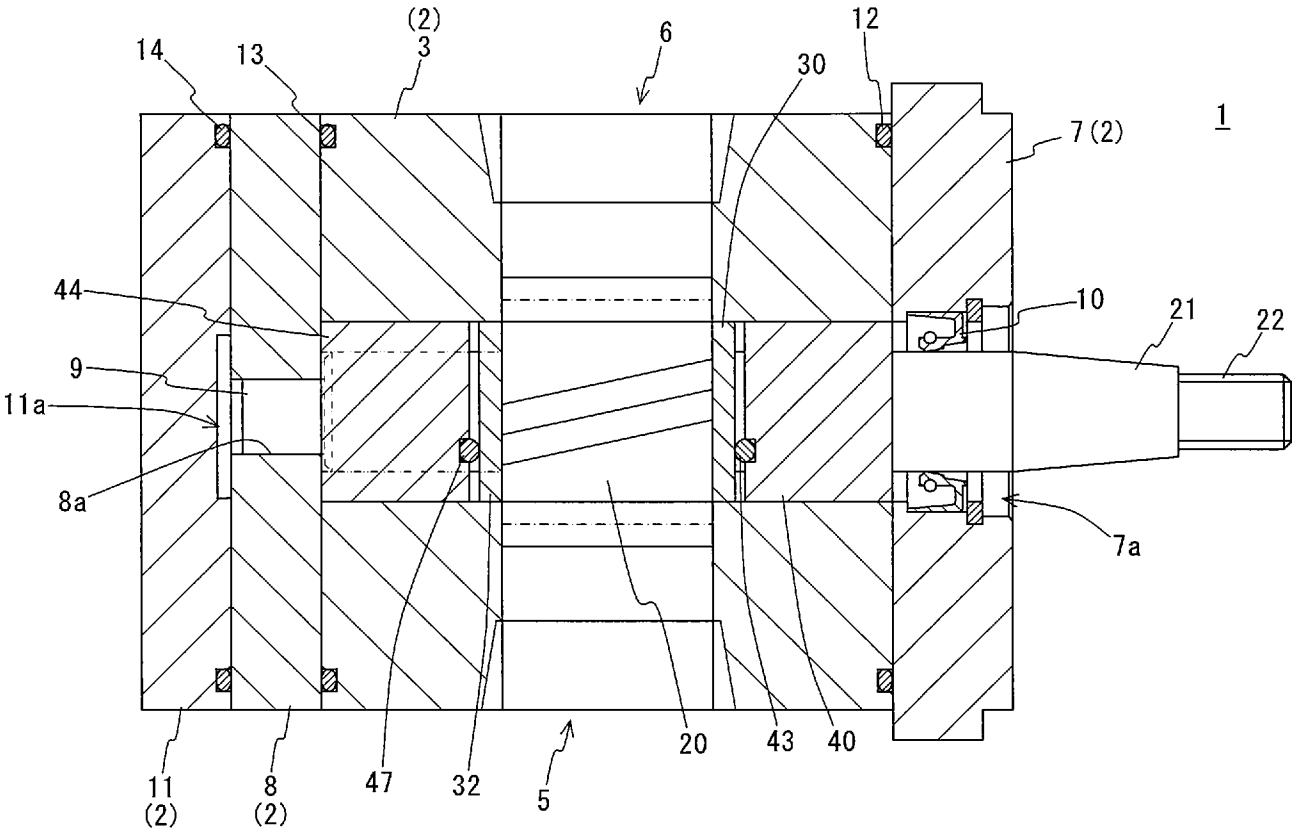
FIG. 2 is a front sectional view taken along the arrows A-A in FIG. 1.

As shown in FIGS. 1 and 2, an oil hydraulic pump 1 has a housing 2 having a hydraulic chamber 4 formed therein, a pair of helical gears which are disposed in the hydraulic chamber 4 and have a tooth profile including an arc portion at a tooth tip and a tooth root and forming a continuous line of contact from one end portion to the other end portion in a face width direction at a meshing portion, that is, a pair of "continuous-line-of-contact meshing gears" as described above (hereinafter, simply referred to as gears) 20, 23, bushes 40, 44 as a pair of bearing members, and a pair of side plates 30, 32.

The housing 2 comprises a body 3 in which the hydraulic chamber 4 having a space with a substantially 8-shaped cross-section is formed from one end surface to the other end surface thereof, a front cover 7 which is liquid-tightly fixed to the one end surface (front end surface) of the body 3 via a seal 12, an intermediate cover 8 which is similarly liquid-tightly fixed to the other end surface (rear end surface) of the body 3 via a seal 13, and an end cover 11 which is liquid-tightly fixed to a rear end surface of the intermediate cover 8 via a seal 14, and the hydraulic chamber 4 is closed by the front cover 7 and the intermediate cover 8.

One of the pair of gears 20, 23 is a driving gear 20 and the other is a driven gear 23, and the driving gear 20 has a right-handed helical tooth portion and the driven gear 23 has a left-handed helical tooth portion. The gears 20, 23 respectively have rotating shafts 21, 24 which are respectively provided to extend in the axial directions of the gears 20, 23 from both end surfaces of the gears 20, 23. Further, the pair of gears 20, 23 are inserted in the hydraulic chamber 4 in a state of meshing with each other so that outer surfaces of their tooth tips are in sliding contact with an inner peripheral surface 3*a* of the hydraulic chamber 4, and the hydraulic chamber 4 is divided in two, a high-pressure side and a low-pressure side, at the meshing portion of the pair of gears 20, 23. Further, an end portion of the rotating shaft 21 on the front side of the driving gear 20 is formed in a tapered shape and a screw portion 22 is formed on the tip thereof, and the end portion of the rotating shaft 21 extends outward through a through hole 7*a* formed in the front cover 7 and an oil seal 10 provides sealing between the outer peripheral surface of the rotating shaft 21 and the inner peripheral surface of the through hole 7*a*.

The body 3 has an intake port (intake flow path) 5, which leads to the low-pressure side of the hydraulic chamber 4, formed in one side surface thereof, and has a discharge port (discharge flow path) 6, which leads to the high-pressure side of the hydraulic chamber 4, formed in another side surface opposite said side surface thereof. The intake port 5 and the discharge port 6 are provided so that their axes are positioned at the middle between the rotating shafts 21, 24 of the pair of gears 20, 23.

The pair of side plates 30, 32 are plate-shaped members having a substantially 8-shaped cross-section and respectively have two through holes 31, 33 formed therein, they are disposed on both sides of the gears 20, 23 in a state where the rotating shafts 21, 24 of the gears 20, 23 are inserted through the through holes 31, 33, and one end surfaces of the side plates 30, 32 are each in contact with the entire end surfaces of the gears 20, 23 including their tooth portions.

Figure 3:
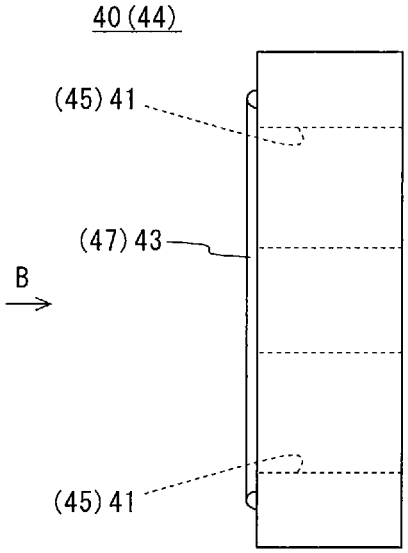
FIG. 3 is a plan view of a bush of the oil hydraulic pump according to the embodiment.
Figure 4:
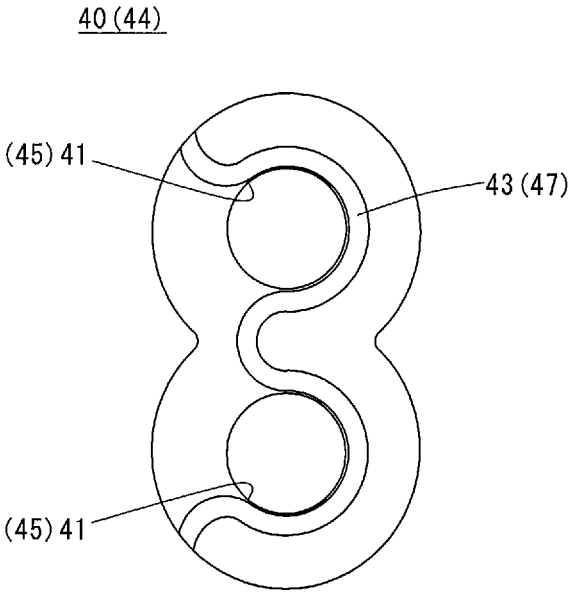
FIG. 4 is a side view as seen in the direction indicated by the arrow B in FIG. 3.

As shown in FIGS. 3 and 4, the bushes 40, 44 are metal bearings comprising a member having a substantially 8-shaped cross-section and respectively have two support holes 41, 45, and they are respectively disposed outside the pair of side plates 30, 32 with the rotating shafts 21, 24 of the gears 20, 23 inserted through the support holes 41, 45 and support the rotating shafts 21, 24 so that they are rotatable.

Further, dividing seals 43, 47 with elasticity, which have a substantially figure-3 shape in side view, are provided on end surfaces facing the side plates 30, 32 of the bushes 40, 44, respectively. The dividing seals 43, 47 respectively divide gaps 50, 51 between the bushes 40, 44 and the side plates 30, 32 into a high-pressure side and a low-pressure side, and a hydraulic oil in the high-pressure side of the hydraulic chamber 4 is introduced into the high-pressure sides of the gaps 50, 51 through an appropriate flow path and the one end surfaces of the side plates 30, 32 are pressed onto the end surfaces of the gears 20, 23 by the high-pressure hydraulic oil introduced into the gaps 50, 51, thereby preventing leakage of the hydraulic oil from the high-pressure side to the low-pressure side. It is noted that, although the high-pressure hydraulic oil in the hydraulic chamber 4 acts also on end surfaces facing the gears 20, 23 of the side plates 30, 32, the side plates 30, 32 respectively have a larger pressure receiving area in the gaps 50, 51 than on their respective gears 20, 23 sides, and, as a result thereof, the side plates 30, 32 are pressed onto the end surfaces of the gears 20, 23 by the difference between the acting forces applied thereto.

Further, the other end surfaces of the bushes 40, 44 are in contact with end surfaces of the front cover 7 and the end cover 11, respectively, thereby creating a state where the end surfaces of the gears 20, 23 and the one end surfaces of the side plates 30, 32 are in contact with each other and the other end surfaces of the side plates 30, 32 and the dividing seals 43, 47 provided on the bushes 40, 44 are in contact with each other and a state where the gears 20, 23, the side plates 30, 32 and the bushes 40, 44 are pressurized.

Further, the intermediate plate 8 has a cylinder hole 8*a* formed at a portion facing an end surface of the rotating shaft 21 on the rear side of the gear 20 thereof, and a piston 9 is inserted through the cylinder hole 8*a*. The end cover 11 has a recess portion 11*a* formed at a portion corresponding to the cylinder hole 8*a* thereof, and the hydraulic oil in the high-pressure side of the hydraulic chamber 4 is supplied into the recess portion 11*a* through a not-shown flow path, so that the hydraulic oil in the high-pressure side acts on the back surface (rear end surface) of the piston 9.

As described above, in this embodiment, the gear 20 has a right-handed helical tooth portion and the gear 23 has a left-handed helical tooth portion. Therefore, when the gear 20 is rotated in the direction indicated by the arrow (clockwise rotation), a backward pressure receiving thrust force $F_{pa}$ generated by the high-pressure hydraulic oil acting on the tooth portion of the gear 20 and a similarly backward meshing thrust force $F_{ma}$ generated by meshing of the gears 20, 23 act on the gear 20, and therefore a combined thrust force $F_x$ which is a resultant force of the pressure receiving thrust force $F_{pa}$ and the meshing thrust force $F_{ma}$ acts thereon.

The size of the cross-sectional area (pressure receiving area) of the piston 9 of this embodiment is set so that a thrust which almost balances the combined thrust force $F_x$ acting on the gear 20 and eliminates the combined thrust force $F_x$ is generated by the high-pressure hydraulic oil acting on the back surface of the piston 9.

The pressure receiving thrust force $F_{pa}$, the meshing thrust force $F_{ma}$ and the combined thrust force $F_x$ can be calculated theoretically. Hereinafter, the theoretical calculation will be explained. It is noted that the meanings of the references used in the explanation given below are as follows:

$V_{th}$: theoretical discharge amount per revolution of pump (gear) ($m^3$/rev)

$r_w$: radius of working pitch circle of gear (m)

b: face width of gear (m)

h: tooth depth of gear (m)

Q: discharge flow rate of pump ($m^3$/sec)

$P_{th}$: hydraulic pressure of pump not taking into account losses (Pa)

P: hydraulic pressure of pump taking into account losses (Pa)

$\eta_m$: mechanical efficiency of pump $\beta_w$: working helix angle of gear (rad)

$\beta_b$: base cylinder helix angle of gear (rad)

$T_d$: input shaft torque applied to rotating shaft of driving gear (Nm)

n: number of revolution of rotating shaft of gear (rev/sec)

ω: angular velocity applied to rotating shaft of driving gear (rad/sec)=2×π×n $T_m$: transmitted torque from driving gear to driven gear (Nm)

$W_p$: workload applied to liquid by driving of pump (J=Nm)

$F_{wt}$: nominal working tangential force (N)

$F_n$: tooth surface normal force (N)

$F_{nt}$: transverse tooth surface normal force (N)

$\alpha_{wt}$: working transverse pressure angle (rad)

$F_{ma}$: meshing thrust force (N)

$F_{pa}$: pressure receiving thrust force (N)

$F_x$: combined thrust force (N)

$\epsilon_\alpha$: transverse contact ratio $\epsilon_\beta$: overlap ratio $\epsilon_r$: ratio of contact ratios ($\epsilon_\beta/\epsilon_\alpha$)

[Meshing Thrust Force]

Hereinafter, calculation of the meshing thrust force $F_{ma}$ will be explained.

First, in a case where mechanical efficiency $\eta_m$ is not taken into account, the following equation holds because an input energy ($T_d \times \omega$) and an output energy ($P_{th} \times Q$) are equal to each other.

(Equation 1)

$$T_d \times \omega = P_{th} \times Q = P_{th} \times V_{th} \times n$$

It is noted that, in a case where the mechanical efficiency $\eta_m$ is taken into account, the following equation holds:

(Equation 2)

$$T_d \times \omega = P_{th} \times V_{th} \times n / \eta_m, \text{ and}$$

the hydraulic pressure of pump (pressure of hydraulic oil) P taking into account the mechanical efficiency $n_m$ is represented by the following equation.

(Equation 3)

$$P = P_{th} \times \eta_m$$

Further, because the theoretical discharge amount of pump $V_{th}$ is approximated by the theoretical discharge amount of two gears, it can be represented by the following equation.

(Equation 4)

$$V_{th} \approx 2\pi \times r_w \times h \times b$$

Further, on the basis of the Equation 1, the Equation 4 and the relationship of $\omega = 2\pi \times n$, the relationship between driving torque and hydraulic pressure of the pump can be represented by the following equation.

(Equation 5)

$$Td \approx 2\pi \times r_w \times h \times b \times P_{th} \times n / \omega = r_w \times h \times b \times P_{th}$$

Furthermore, because the gears of the pump have the same geometric shape and their workloads are equal to each other, the transmitted torque $T_m$ transmitted from the driving gear to the driven gear can be represented by the following equation.

(Equation 6)

$$T_m \approx 0.5\ T_d = 0.5\ r_w \times h \times b \times P_{th}$$

The transmitted torque $T_m$ and the nominal tangential force generated on the working pitch circle (nominal working tangential force) $F_{wt}$ have the relationship represented by the following equation.

(Equation 7)

$$F_{wt} = T_m / r_w$$

Figure 5:
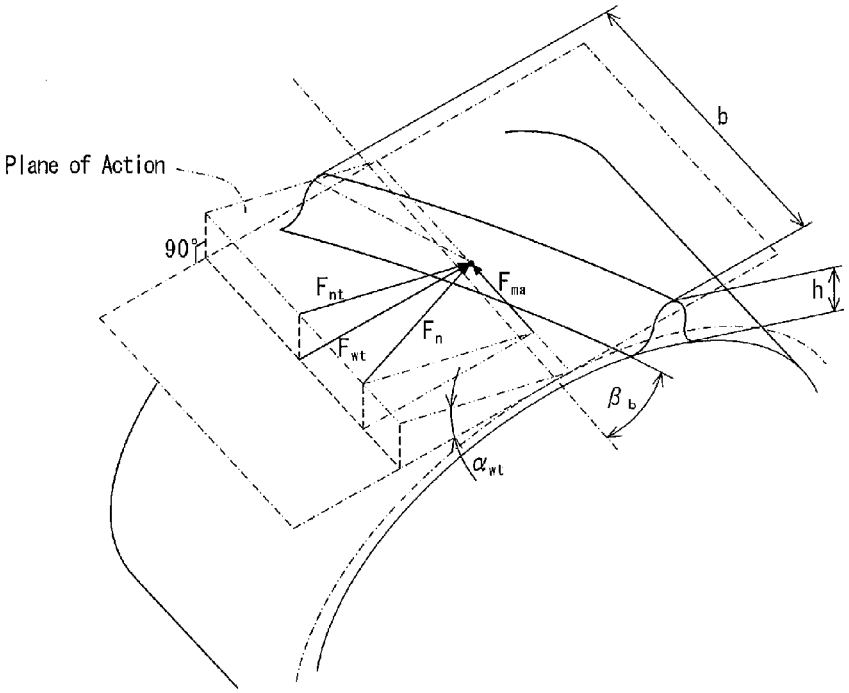
FIG. 5 is an illustration for explaining a meshing thrust force.

Further, as shown in FIG. 5, because the nominal working tangential force $F_{wt}$ is a working-pitch-circle circumferential component of the transverse tooth surface normal force $F_{nt}$ which is obtained by projecting the tooth surface normal force $F_n$ on the transverse cross-section of the gear, the relationship between them can be represented by the following equations.

(Equation 8)

$$F_{wt} = F_{nt} \times \cos \alpha_{\omega t}$$

(Equation 9)

$$F_{nt} = F_n \times \cos \beta_b$$

(Equation 10)

$$F_n = F_{wt} / (\cos \alpha_{\omega t} \times \cos \beta_b)$$

(Equation 11)

$$F_{ma} = F_n \times \sin \beta_b$$

On the basis of the Equations 8 to 11, the meshing thrust force $F_{ma}$ can be represented by the following equation.

(Equation 12)

$$F_{ma} = F_{wt} \times \tan \beta_b / \cos \alpha_{\omega t}$$

Further, on the basis of the basic theory of helical gear, there is the relationship of $$\tan \beta_b = \tan \beta_w \times \cos \alpha_{\omega t},$$

and therefore, on the basis of this relationship and the Equations 6, 7 and 12, eventually the meshing thrust force $F_{ma}$ can be represented by the following equation.

(Equation 13)

$$F_{ma} \approx 0.5 h \times b \times P_{th} \times \tan \beta_w$$

The meshing thrust force $F_{ma}$ calculated by the Equation 13 acts on the gears 20, 23.

[Pressure Receiving Thrust Force]

Figure 6:
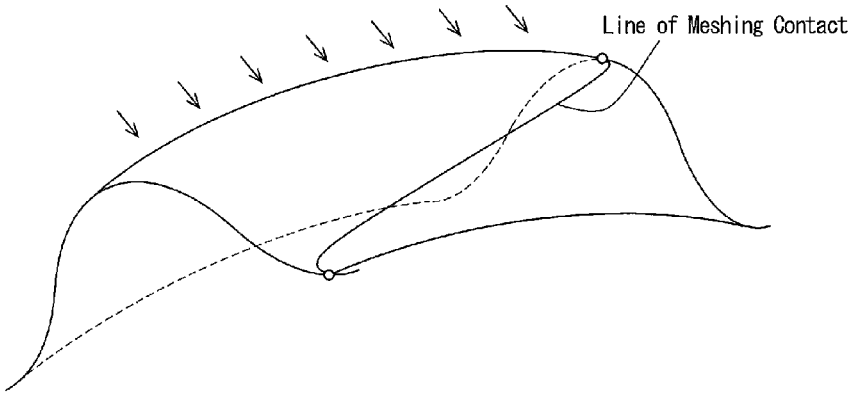
FIG. 6 is an illustration for explaining a pressure receiving thrust force.
Figure 7:
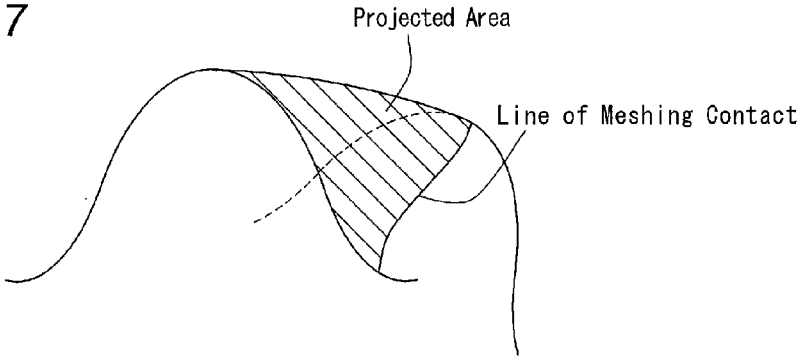
FIG. 7 is an illustration for explaining the pressure receiving thrust force.

In a helical gear (continuous-line-of-contact meshing gear) which has a tooth profile, as shown in FIG. 6, including an arc portion in a tooth tip and a tooth root and forming a continuous line of contact (line of meshing contact) from one end to the other end in a face width direction at a meshing portion, the line of meshing contact separates a discharge side and an intake side, and therefore an acting force generated by the pressure difference between both sides of the line of contact acts on a tooth on which the line of contact is formed, and the pressure receiving thrust force $F_{pa}$, which is a thrust-directional component along the gear shaft of the acting force, can be evaluated by multiplying an area obtained by projecting a tooth surface on which a hydraulic pressure acts on a plane perpendicular to the gear shaft (rotating shaft) (see FIG. 7) and the hydraulic pressure force.

Further, because the pressure receiving thrust force $F_{pa}$ varies depending on the meshing manner of the pair of gears, this has to be calculated in accordance with the meshing manner. In the field of gear, as indices of the meshing manner, an index called the transverse contact ratio $\epsilon_\alpha$ and an index called the overlap ratio $\epsilon_\beta$ are known. Generally the distance between teeth measured in the normal direction of the tooth is called the normal pitch and the length of actual meshing on the line of action is called the length of action, and the transverse contact ratio $\epsilon_\alpha$ is the value obtained by dividing the length of action by the normal pitch. Further, in a case of helical gears, because their tooth traces are helical, the length of meshing between a pair of teeth is longer than that in a case of spur gears, and the increment of the contact ratio due to their helices is called the overlap ratio $\epsilon_\beta$, and when the length of the long meshing due to their helices is evaluated on the plane of action, it is $b \times \tan \beta_b$, and therefore the overlap ratio $\epsilon_\beta$ can be represented by the following equation.

(Equation 14)

$$\epsilon_\beta = b \times \tan \beta_b / p_b b \times \tan \beta_w / p_w,$$

where $p_b$ is the normal pitch and $p_w$ is the pitch on the pitch circle.

Further, in the present invention, the ratio of contact ratios $\epsilon_r (= \epsilon_\beta / \epsilon_\beta)$ which is the ratio of the transverse contact ratio $\epsilon_\alpha$ to the overlap ratio $\epsilon_\beta$ is used as an index of the meshing manner of the helical gears. The reason therefor is that, because, in a case of a "continuous-line-of-contact meshing gear", the state of a line of contact at a meshing portion varies depending on the value of the ratio of contact ratios $\epsilon_r$ and therefore an area where a hydraulic pressure acts on the tooth surface varies, it is necessary to perform case classification based on the value of the ratio of contact ratios $\epsilon_r$ and evaluate the area where a hydraulic pressure acts on the tooth surface to calculate the pressure receiving thrust force $F_{pa}$ which is generated by the hydraulic pressure.

Figure 8:
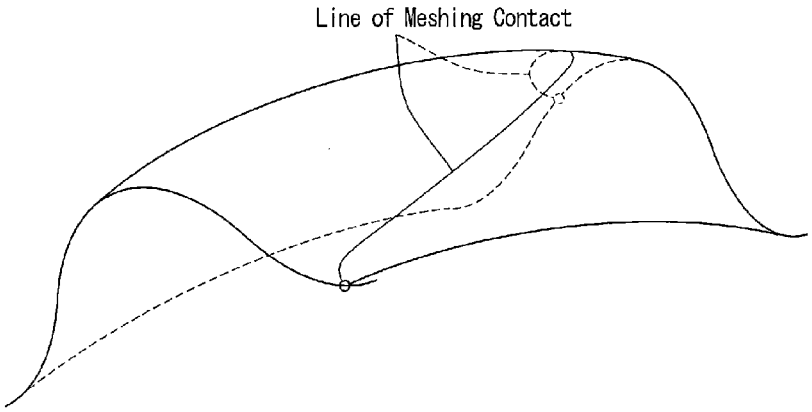
FIG. 8 is an illustration showing a specific mode of meshing of gears.
Figure 9:
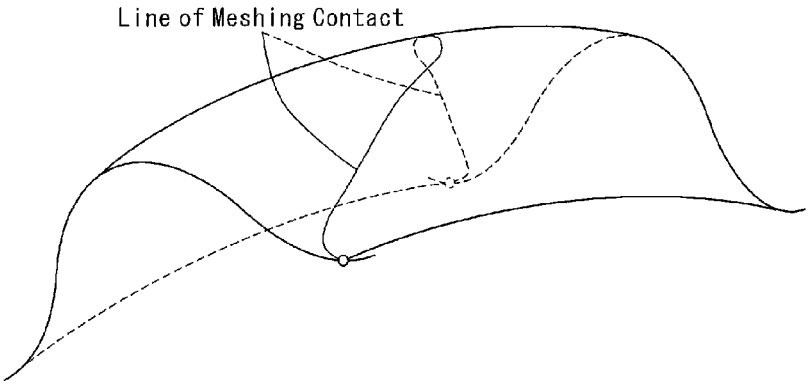
FIG. 9 is an illustration showing a specific mode of meshing of gears.
Figure 10:
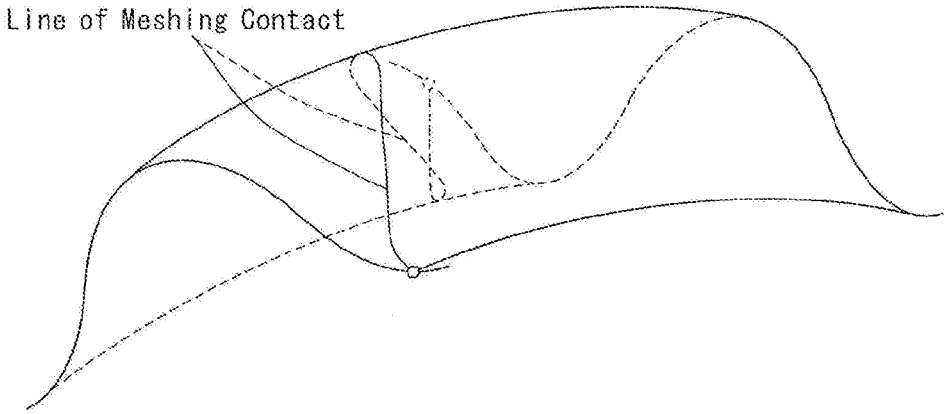
FIG. 10 is an illustration showing a specific mode of meshing of gears.
Figure 11:
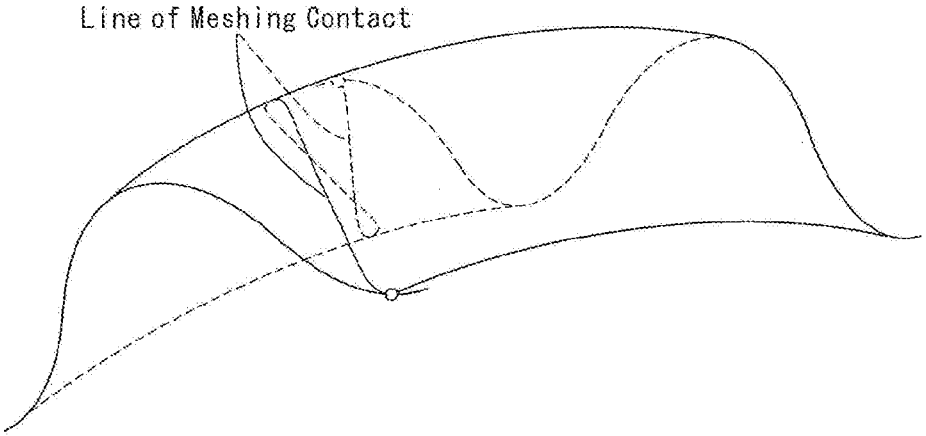
FIG. 11 is an illustration showing a specific mode of meshing of gears.

It is noted that, as for what kind of line of contact is formed in accordance with the value of the ratio of contact ratios $\epsilon_r$, specific modes are shown in FIGS. 8 to 11. The example shown in FIG. 8 is a case of $1<\epsilon_r<2$, the example shown in FIG. 9 is a case of $\epsilon_r=2$, the example shown in FIG. 10 is a case of $2<\epsilon_r<3$, and the example shown in FIG. 11 is case of $\epsilon_r=3$. In the examples shown in FIGS. 8 and 9, a line of contact is formed on one tooth when one end of the line of contact is located at a tooth root, and, in the examples shown in FIGS. 10 and 11, a line of contact is formed across two teeth when one end of the line of contact is similarly located at a tooth root.

Next, a method of calculating the area where a hydraulic pressure acts on a tooth surface of a gear is explained.

Figure 12:
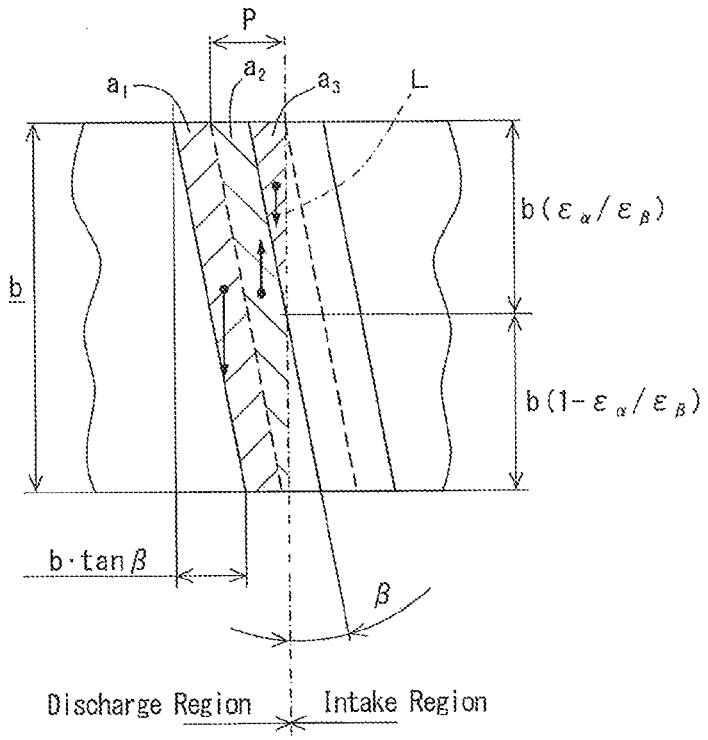
FIG. 12 is an illustration for explaining a pressure receiving area of a gear.
Figure 13:
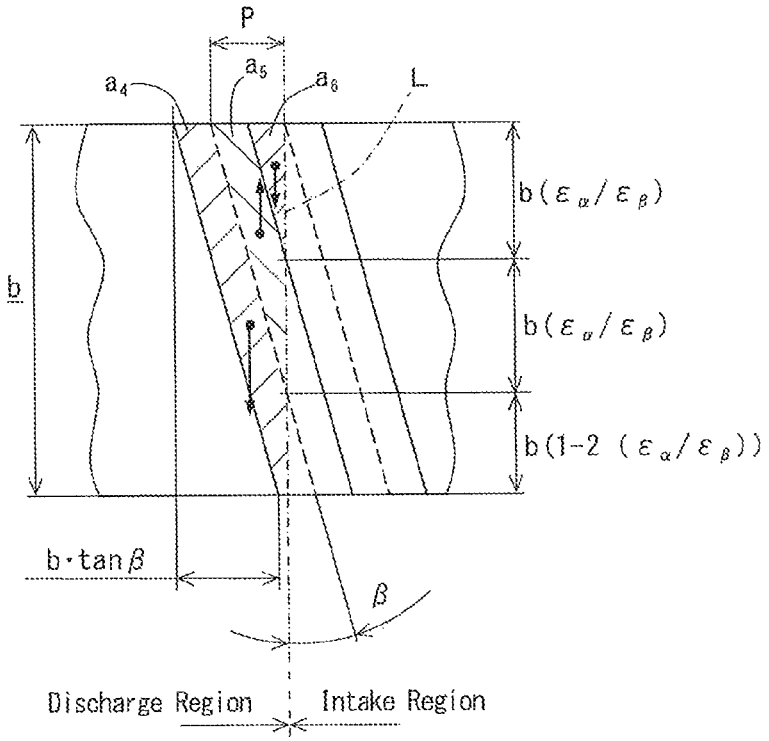
FIG. 13 is an illustration for explaining the pressure receiving area of a gear.

FIGS. 12 and 13 show plan views showing a meshing portion of gears, and FIG. 12 shows gears having a tooth profile which provides a ratio of contact ratios $\epsilon_r$ in the range of $1<=\epsilon_r<=2$, and FIG. 13 shows gears having a tooth profile which provides a ratio of contact ratios $\epsilon_r$ in the range of $2<=\epsilon_r<=3$. In each figure, the oblique solid lines indicate ridge lines of tooth tips and the oblique broken lines indicate lines of tooth roots.

First, in a case of gears having a tooth profile which provides a ratio of contact ratios $\epsilon_r$ in the range of $1<=\epsilon_r<=2$, a hydraulic pressure acts on regions $a_1$, $a_2$ and $a_3$ with a line of meshing contact L as a border. The hydraulic pressure acts on the regions $a_1$ and $a_3$ in the same thrust direction, and the hydraulic pressure acts on the region $a_2$ in the opposite thrust direction. Therefore, an effective pressure receiving area $Ap_1$ taking into account a cancellation by the difference of direction can be represented by the following equation, wherein the area from tooth root to tooth tip of one tooth surface is A.

(Equation 15)

$$Ap_1=A((\epsilon_r-1)^2+1)/2\epsilon_r$$

Similarly, in a case of gears having a tooth profile which provides a ratio of contact ratios $\epsilon_r$ in the range of $2<=\epsilon_r<=3$, because a hydraulic pressure acts on regions $a_4$ and $a_6$ in the same thrust direction and acts on a region $a_5$ in the opposite thrust direction with a line of meshing contact L as a border, an effective pressure receiving area $Ap_2$ taking into account a cancellation by the difference of direction can be represented by the following equation.

(Equation 16)

$$Ap_2=A-A((\epsilon_r-2)^2+2)/2\epsilon_r$$

As described above, the effective pressure receiving area which causes a thrust force due to a hydraulic pressure varies depending on the value of the ratio of contact ratios $\epsilon_r$.

Next, the pressure receiving thrust force $F_{pa}$ is calculated on the basis of the pressure receiving area $Ap_1$, $Ap_2$ obtained in the way as described above. It is noted that an area $A_x$ obtained by projecting the area A on a plane perpendicular to the gear shaft can be evaluated by the following equation on the basis of an angle of rotation θ of a tooth seen from the plane perpendicular to the gear shaft, the radius of working pitch circle $r_w$ and the tooth depth h.

(Equation 17)

$$A_x=h\times r_w\times\eta=h\times b\times\tan\beta_w$$

[Pressure Receiving Thrust Force not Taking into Account Mechanical Efficiency]

As described above, the pressure receiving thrust force $F_{pa}$ can be evaluated by multiplying an area obtained by projecting a tooth surface on which a hydraulic pressure acts on a plane perpendicular to the gear shaft (rotating shaft), that is, the area $A_x$ and the hydraulic pressure force.

Therefore, in the case of $1<=\epsilon_r<=2$, the pressure receiving thrust force $F_{pa1}$ which is generated by the hydraulic pressure $P_{th}$ not taking into account the mechanical efficiency $\eta_m$ can be represented by the following equation on the basis of the Equations 15 and 17.

(Equation 18)

$$F_{pa1}=P_{th}\times Ap_1=P_{th}\times h\times b\times\tan\beta_w\times((\epsilon_r-1)^2+1)/2\epsilon_r$$

Further, in the case of $2<=\epsilon_r<=3$, the pressure receiving thrust force $F_{pa2}$ which is generated by a hydraulic pressure $P_{th}$ not taking into account the mechanical efficiency $\eta_m$ can be represented by the following equation on the basis of the Equations 16 and 17.

(Equation 19)

$$F_{pa2}=P_{th}\times Ap_2=P_{th}\times h\times b\times\tan\beta_w\times(2\epsilon_r-((\epsilon_r-2)^2+2))/2\epsilon_r$$

[Combined Thrust Force not Taking into Account Mechanical Efficiency]

On the basis of the above-described Equations 13, 18 and 19, in a case of the oil hydraulic pump 1 as shown in FIG. 1, the combined thrust force $F_{xp}$ acting on the driving gear 20 and the rotating shaft 21 can be represented by the following equation.

(Equation 20)

in the case of $1<=\epsilon_r<=2$ $$F_{xp1}=F_{ma}+F_{pa1}\approx 0.5h\times b\times P_{th}\times\tan\beta_w+P_{th}\times h\times b\times\tan\beta_w\times((\epsilon_r-1)^2+1)/\epsilon_r$$

(Equation 21)

in the case of $2<=\epsilon_r<=3$ $$F_{xp2}=F_{ma}+F_{pa2}\approx 0.5h\times b\times P_{th}\times\tan\beta_w+P_{th}\times h\times b\times\tan\beta_w\times(2\epsilon_r-((\epsilon_r-2)^2+2))/2\epsilon_r$$

On the other hand, the combined thrust force $F_{xg}$ acting on the driven gear 23 and the rotating shaft 24 can be represented by the following equation.

(Equation 22)

in the case of $1<=\epsilon_r<=2$ $$F_{xg1}=-F_{ma}+F_{pa1}\approx -0.5h\times b\times P_{th}\times\tan\beta_w+P_{th}\times h\times b\times\tan\beta_w\times((\epsilon_r-1)^2+1)/2\epsilon_r$$

(Equation 23)

in the case of $2<=\epsilon_r<=3$ $$F_{xg2}=-F_{ma}+F_{pa2}\approx -0.5h\times b\times P_{th}\times\tan\beta_w+P_{th}\times h\times b\times\tan\beta_w\times(2\epsilon_r-((\epsilon_r-2)^2+2))/2\epsilon_r$$

Further, on the basis of the Equations 20 to 23, when the ratio of contact ratios $\epsilon_r$ is set to 1, 2 or 3, the combined thrust forces $F_{xp}$ and $F_{xg}$ are as follows. It is noted that the combined thrust forces when $\epsilon_r=1$ are $F_{xp1'}$ and $F_{xg1'}$, the combined thrust forces when $\epsilon_r=2$ are $F_{xp2'}$ and $F_{xg2'}$, and the combined thrust forces when $\epsilon_r=3$ are $F_{xp3'}$ and $F_{xg3'}$.

(Equation 24)

$$F_{xp1'} \approx h \times b \times P_{th} \times \tan \beta_w$$

(Equation 25)

$$F_{xg1'} \approx -0.5h \times b \times P_{th} \times \tan \beta_w + (P_{th} \times h \times b \times \tan \beta_w)/2 = 0$$

(Equation 26)

$$F_{xp2'} \approx h \times b \times P_{th} \times \tan \beta_w$$

(Equation 27)

$$F_{xg2'} \approx -0.5h \times b \times P_{th} \times \tan \beta_w + (P_{th} \times h \times b \times \tan \beta_w)/2 = 0$$

(Equation 28)

$$F_{xp3'} \approx h \times b \times P_{th} \times \tan \beta_w$$

(Equation 29)

$$F_{xg3'} \approx -0.5h \times b \times P_{th} \times \tan \beta_w + (P_{th} \times h \times b \times \tan \beta_w)/2 = 0$$

Thus, in a case where it is assumed that mechanical losses are not taken into account, that is, the mechanical efficiency $\eta_m$ is 100%, when the ratio of contact ratios $\epsilon_r$ is set to 1, 2 or 3, the combined thrust force $F_{xg1'}$, $F_{xg2'}$, $F_{xg3'}$ acting on the driven gear 23 and the rotating shaft 24 is 0 in each case, and it is seen that the driven gear 23 and the rotating shaft 24 are in a state where no thrust force acts thereon. On the other hand, the combined thrust force $F_{xp1'}$, $F_{xp2'}$, $F_{xp3'}$ acting on the driving gear 20 and the rotating shaft 21 is $h \times b \times P_{th} \times \tan \beta_w$ in each case.

In view of the foregoing, in the case where mechanical losses are not taken into account, setting the ratio of contact ratios $\epsilon_r$ to 1, 2 or 3 makes it possible to create a state where no thrust force acts on the driven gear 23 and the rotating shaft 24, and applying a force equal to $h \times b \times P_{th} \times \tan \beta_w$ to the rotating shaft 21 of the driving gear 20 as a drag makes it possible to create a state where no thrust force acts on the driving gear 20, the rotating shaft 21, the driven gear 23 and the rotating shaft 24. It is noted that, in a case of $\epsilon_r <= 1$, it is not possible to obtain practical gears 20, 23.

Thus, in an oil hydraulic pump (hydraulic device) using "continuous-line-of-contact meshing gears", in a case where mechanical losses are not taken into account, setting the tooth profiles of the driving gear 20 and the driven gear 23 to such a tooth profile that the ratio of contact ratios $\epsilon_r$ is 2 or 3 makes it possible to create a state where no thrust force acts on the driven gear 23 and the rotating shaft 24. However, because a hydraulic device always involves mechanical losses, in the strict sense, it is required that no thrust force act on the driven gear 23 and the rotating shaft 24 in a state where the mechanical efficiency $\eta_m$ is taken into account. Therefore, hereinafter, the combined thrust forces $F_{xp}$, $F_{xg}$ taking into account the mechanical efficiency $\eta_m$ are considered.

[Pressure Receiving Thrust Force Taking into Account Mechanical Efficiency]

The pressure receiving thrust force $F_{pa1}$ generated by the hydraulic pressure P taking into account the mechanical efficiency $\eta_m$ can be represented by the following equation which is made by replacing $P_{th}$ in the Equations 18 and 19 with P.

(Equation 30)

in the case of $1 <= \epsilon_r <= 2$ $$F_{pa1} = P \times h \times b \times \tan \beta_w \times ((\epsilon_r - 1)^2 + 1)/2\epsilon_r$$

(Equation 31)

in the case of $2 <= \epsilon_r <= 3$ $$F_{pa2} = P \times h \times b \times \tan \beta_w \times (2\epsilon_r - ((\epsilon_r - 2)^2 + 2))/2\epsilon_r$$

[Combined Thrust Force Taking into Account Mechanical Efficiency]

Further, the combined thrust force $F_{xp}$ acting on the driving gear 20 and the rotating shaft 21 and the combined thrust force $F_{xg}$ acting on the driven gear 23 and the rotating shaft 24, which are combined thrust forces taking into account the mechanical efficiency $\eta_m$, are represented by the following equations.

(Equation 32)

in the case of $1 <= \epsilon_r <= 2$ $$F_{xp1} \approx 0.5h \times b \times P_{th} \times \tan \beta_w + P \times h \times b \times \tan \beta_w \times ((\epsilon_r - 1)^2 + 1)/2\epsilon_r$$

(Equation 33)

in the case of $2 <= \epsilon_r <= 3$ $$F_{xp2} \approx 0.5h \times b \times P_{th} \times \tan \beta_w + P \times h \times b \times \tan \beta_w \times (2\epsilon_r - ((\epsilon_r - 2)^2 + 2))/2\epsilon_r$$

(Equation 34)

in the case of $1 <= \epsilon_r <= 2$ $$F_{xg1} \approx -0.5h \times b \times P_{th} \times \tan \beta_w + P \times h \times b \times \tan \beta_w \times ((\epsilon_r - 1)^2 + 1)/2\epsilon_r$$

(Equation 35)

in the case of $2 <= \epsilon_r <= 3$ $$F_{xg2} \approx -0.5h \times b \times P_{th} \times \tan \beta_w + P \times h \times b \times \tan \beta_w \times (2\epsilon_r - ((\epsilon_r - 2)^2 + 2)/2\epsilon_r)$$

In view of the foregoing, although the inventors considered, using the Equations 34 and 35, a case where the combined thrust force $F_{xg2}$ acting on the driven gear 23 and the rotating shaft 24 would be 0, a practical solution could not be obtained in the case of $1 <= \epsilon_r <= 2$. On the other hand, they found out that a practical solution could be obtained in the case of $2 <= \epsilon_r <= 3$.

Although it is said that a practical range of the mechanical efficiency $\eta_m$ is generally $0.91 <= \eta_m <= 0.99$, if $\eta_m = 0.95$, $\epsilon_r$ which makes $F_{xg2}$ 0 in the Equation 35 is calculated by the following equation. It is noted that $P = P_{th} \times \eta_m$ holds on the basis of the Equation 3.

(Equation 36)

$$0.5P_{th} \times h \times b \times \tan \beta_w = 0.95P_{th} \times h \times b \times \tan \beta_w \times (2\epsilon_r - ((\epsilon_r - 2)^2 + 2)/2\epsilon_r)$$

$$0.5/0.95 = (2\epsilon_r - ((\epsilon_r - 2)^2 + 2)/2\epsilon_r)$$

When solving the quadratic equation of the Equation 36, two solutions, $\epsilon_r = 2.13$, 2.82, are obtained. Therefore, in a case where it is assumed that the mechanical efficiency $\eta_m = 0.95$, the combined thrust force $F_{xg2}$ acting on the driven gear 23 and the rotating shaft 24 can be made 0 by making the gears to have such a tooth profile that the ratio of contact ratios $\epsilon_r$ is 2.13 or 2.82.

Taking into consideration the foregoing, when evaluating the relationship between $\epsilon_r$ and $\eta_m$ which makes $F_{xg2}$ 0 in the Equation 35, the following equation holds.

(Equation 37)

$$0.5P_{th}\times h\times b\times\tan\beta_w=\eta_m\times P_{th}\times h\times b\times\tan\beta_w\times(2\epsilon_r-((\epsilon_r-2)^2+2)/2\epsilon_r)$$

$$\eta_m=2\epsilon_r/(2\times(2\epsilon_r-((\epsilon_r-2)^2+2)))=\epsilon_r/(6\epsilon_r-\epsilon_r^2-6)$$

Thus, by calculating, using the Equation 37, a ratio of contact ratios $\epsilon_r$ which meets the Equation 37 in accordance with a mechanical efficiency $\eta_m$ which is assumed to be preferable for practical use and making the gears 20, 23 to have a tooth profile corresponding to the calculated ratio of contact ratios $\epsilon_r$, the combined thrust force $F_{xg2}$ acting on the driven gear 23 and the rotating shaft 24 can be made 0.

As described above, by making the gears 20, 23 to have such a tooth profile that the ratio of contact ratios $\epsilon_r$ meets $2<=\epsilon_r<=3$, the combined thrust force $F_{xg}$ acting on the driven gear 23 and the rotating shaft 24 can be made 0 within an appropriate mechanical efficiency $\eta_m$. That is, it is possible to create a state where no thrust force acts on the driven gear 23 and the rotating shaft 24. Further, in this embodiment, the gears 20, 23 have such a tooth profile.

On the other hand, in a case where the gears 20, 23 are made to have such a tooth profile that the ratio of contact ratios $\epsilon_r$ meets $2<=\epsilon_r<=3$, the combined thrust force $F_{xp}(=F_{xp2})$ calculated by the Equation 33 acts on the driving gear 20 and the rotating shaft 21. Therefore, when a thrust of the piston 9 pressing the rotating shaft 21 is equal to the combined thrust force $F_{xp}$ calculated by the Equation 33, they are balanced and a state where no thrust force acts on the rotating shaft 21 can be created. Further, for causing the piston 9 to generate such a thrust, the cross-sectional area S ($mm^2$) of the piston 9 can be calculated by the following equation, where the pressure of the hydraulic oil in the high pressure side is P (the pressure of the hydraulic oil taking into account the mechanical efficiency).

(Equation 38)

$$S\times P=F_{xp}(=F_{xp2})$$

$$S\times P=0.5h\times b\times P\times\tan\beta_w/\eta_m+P\times h\times b\times\tan\beta_w\times(2\epsilon_r-((\epsilon_r-2)^2+2))/2\epsilon_r$$

$$S=0.5h\times b\times\tan\beta_w/\eta_m+h\times b\times\tan\beta_w\times(2\epsilon_r-((\epsilon_r-2)^2+2))/2\epsilon_r$$

It is noted that, because the oil hydraulic pump 1 involves various variable elements such as variation in machining and assembling and variation related to the modulus of elasticity of an elastic seal for enabling the rotating shafts to move in their axial directions and the combined thrust force $F_{xp}$ also varies in accordance with the variable elements, taking this into consideration, it is preferred that the cross-sectional area S is set to meet the following equation.

(Equation 39)

$$0.9(F_{xp}/P)<=S<=1.1(F_{xp}/P)$$

According to the oil hydraulic device 1 having the above-described configuration, appropriate piping which is connected to an appropriate tank for storing a hydraulic oil therein is connected to the intake port 5 of the housing 2 and appropriate piping which is connected to an appropriate oil hydraulic equipment is connected to the discharge port 6, and further an appropriate drive motor is connected to the screw portion 22 of the rotating shaft 21 of the driving gear 20. Then, the drive motor is driven to rotate the driving gear 20.

Thereby, the driven gear 23 meshing with the driving gear 20 rotates, a hydraulic oil in a space between the inner peripheral surface 3*a* of the hydraulic chamber 4 and the tooth portions of the gears 20, 23 is transferred to the discharge port 6 side by the rotations of the gears 20, 23, and thereby the discharge port 6 side becomes a high-pressure side and the intake port 5 side becomes a low-pressure side with the meshing portion of the pair of gears 20, 23 as a border.

Further, when the intake port 5 side is brought into a negative pressure by the transfer of the hydraulic oil to the discharge port 6 side, the hydraulic oil in the tank is inhaled into the low-pressure side of the hydraulic chamber 4 through the piping and the intake port 5, and, similarly, the hydraulic oil in the space between the inner peripheral surface of the hydraulic chamber 4 and the tooth portions of the gears 20, 23 is transferred to the discharge port 6 side by the rotations of the gears 20, 23 and is pressurized to a high pressure and transmitted to the oil hydraulic equipment through the discharge port 6 and the piping.

Further, the high-pressure hydraulic oil is lead into the gaps 50, 51 between the bushes 40, 44 and the side plates 30, 32 through the flow path and the side plates 30, 32 are pressed onto the end surfaces of the gears 20, 23 by the function of the hydraulic oil, thereby preventing leakage of the hydraulic oil from the high-pressure side to the low-pressure side.

By the way, as described above, in the oil hydraulic pump 1 using the helical gears 20, 23 of this embodiment, although the combined thrust force $F_x$, which is a resultant force of the pressure receiving thrust force $F_{pa}$ and the meshing thrust force $F_{ma}$, acts on the gear 20, since a force which almost balances and resists the combined thrust force $F_x$ is caused to act on the rear end surface of the rotating shaft 21 of the gear 20 by the piston 9, a state where no thrust force acts on the gear 20 is achieved.

On the other hand, since the pressure receiving thrust force $F_{pa}$ and the meshing thrust force $F_{ma}$ act on the gear 23 in the opposite directions, they are canncelled, and, particularly, using "continuous-line-of-contact meshing gears" as the helical gears 20, 23 like this embodiment and making the gears to have such a tooth profile that the ratio of contact ratios $\epsilon_r$ meets $2<=\epsilon_r<=3$ makes it possible to create a state where no thrust force acts on the gear 23.

Thus, in the oil hydraulic pump 1 of this embodiment, a state where both of the pair of gears 20, 23 do not receive a thrust-directional force can be achieved, and therefore the above-described conventional problem that seizure or damage due to a thrust force occurs on the side plates 30, 32 which are in sliding contact with both end surfaces of the pair of gears 20, 23 is not caused.

Further, since the hydraulic oil in the high-pressure side is caused to act on the back surfaces of the side plates 30, 32 and thereby the side plates 30, 32 are brought into tight contact with both end surfaces of the gears 20, 23, and the side plates 30, 32 are supported by bringing the dividing seals 43, 47 with elasticity into tight contact with the back surfaces of the side plates 30, 32, even if periodic variation occurs on the pressure receiving thrust force $F_{pa}$ or the meshing thrust force $F_{ma}$ or sudden vibration occurs on the oil hydraulic pump 1, such variation and sudden vibration are absorbed by movement of the gears 20, 23 and the side plates 30, 32 in the axial directions of the rotating shafts 21, 24 by elastic deformation of the dividing seals 43, 47, thereby suppressing the occurrence of noise caused by such variation and vibration.

Further, in the oil hydraulic pump 1 of this embodiment, since providing the piston 9 for causing a reaction force to act on only the rotating shaft 21 of the gear 20 achieves the state where no thrust force acts on both of the pair of gears 20, 23, it is possible to solve the above-described conventional problem while reduing costs for manufacturing the oil hydraulic pump 1.

Thus, although one embodiment of the present invention has been described, a specific mode in which the present invention can be realized is not limited thereto.

For example, although the above-described embodiment has the configuration in which the side plates 30, 32 are provided between the gears 20, 23 and the bushes 40, 44 to be in contact with the gears 20, 23 and the spaces between the bushes 40, 44 and the side plates 30, 32 are divided by the dividing seals 43, 47, the present invention incudes also modes in which the side plates 30, 32 and the dividing seals 43, 47 as described above are not provided.

Figure 14:
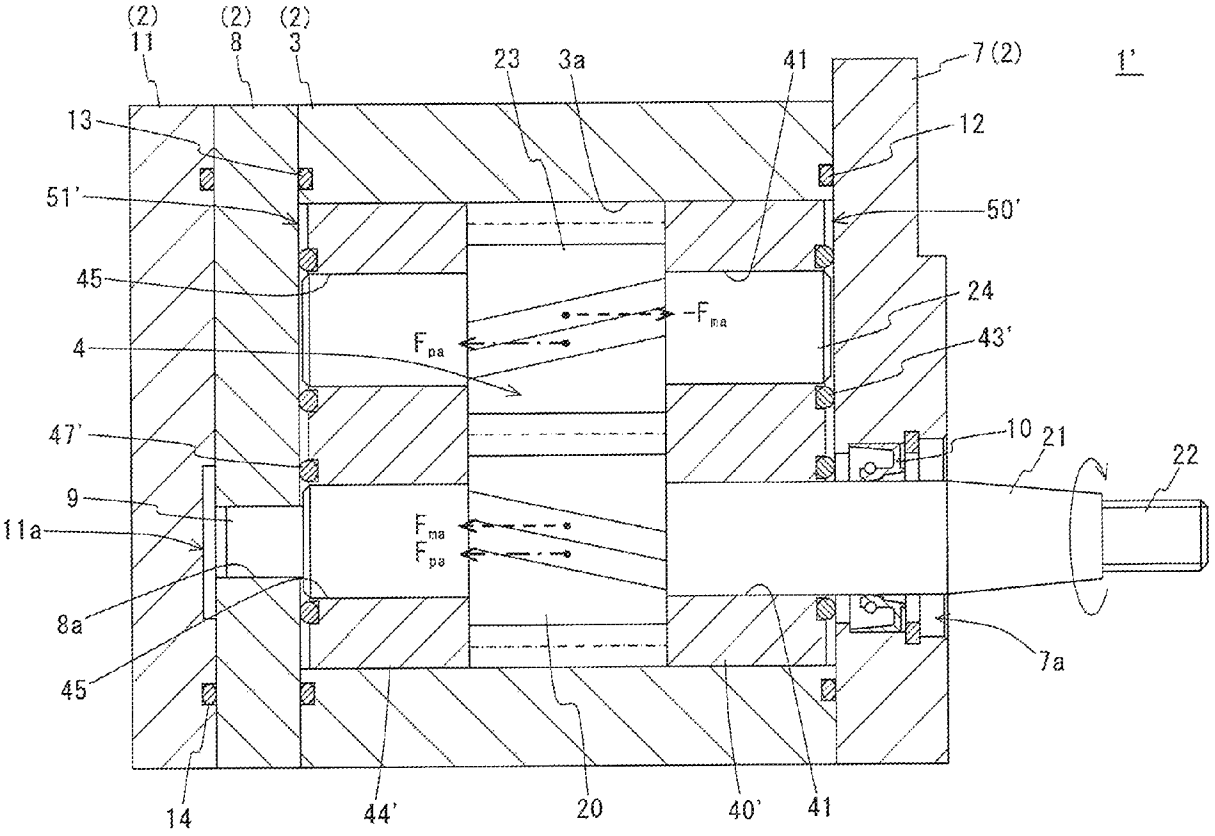
FIG. 14 is a plan sectional view of an oil hydraulic pump according to another embodiment of the present invention.
Figure 15:
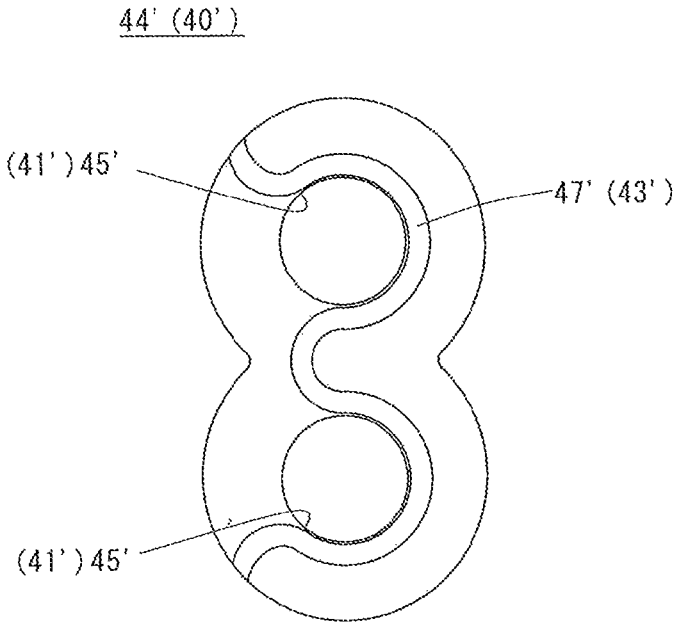
FIG. 15 is a side view of a bush according to the embodiment shown in FIG. 14.

Further, in a mode in which the side plates 30, 32 are not provided, as shown in FIGS. 14 and 15, there may be an oil hydraulic pump 1' having a configuration in which bushes 40', 44' are disposed to be in contact with the end surfaces of the gears 20, 23, a diving seal 43' with elasticity is interposed between the bush 40' and the front cover 7 and a diving seal 47' with elasticity is interposed between the bush 44' and the intermediate cover 8, and a high oil pressure is supplied into a space 50' between the bush 40' and the front cover 7 and a space 51' between the bush 44' and the intermediate cover 8.

Also in this configuration, the bushes 40', 44' are pressed onto the end surfaces of the gears 20, 23, thereby preventing leakage of the hydraulic oil through the end surfaces of the gears 20, 23. Further, the movability of the gears 20, 23 and the bushes 40', 44' in the axial directions of the rotating shafts 21, 24 is secured by elastic deformation of the dividing seals 43', 47', and even if periodic variation occurs on the pressure receiving thrust force $F_{pa}$ or the meshing thrust force $F_{ma}$ or sudden vibration occurs on the oil hydraulic pump 1', these are absorbed by the movement of the gears 20, 23 and the bushes 40', 44' in the axial directions, thereby suppressing the occurrence of noise caused by the variation and the vibration.

It is noted that, in FIG. 14, the same components as those of the oil hydraulic pump 1 shown in FIGS. 1 to 4 are indicated by the same references.

Figure 16:
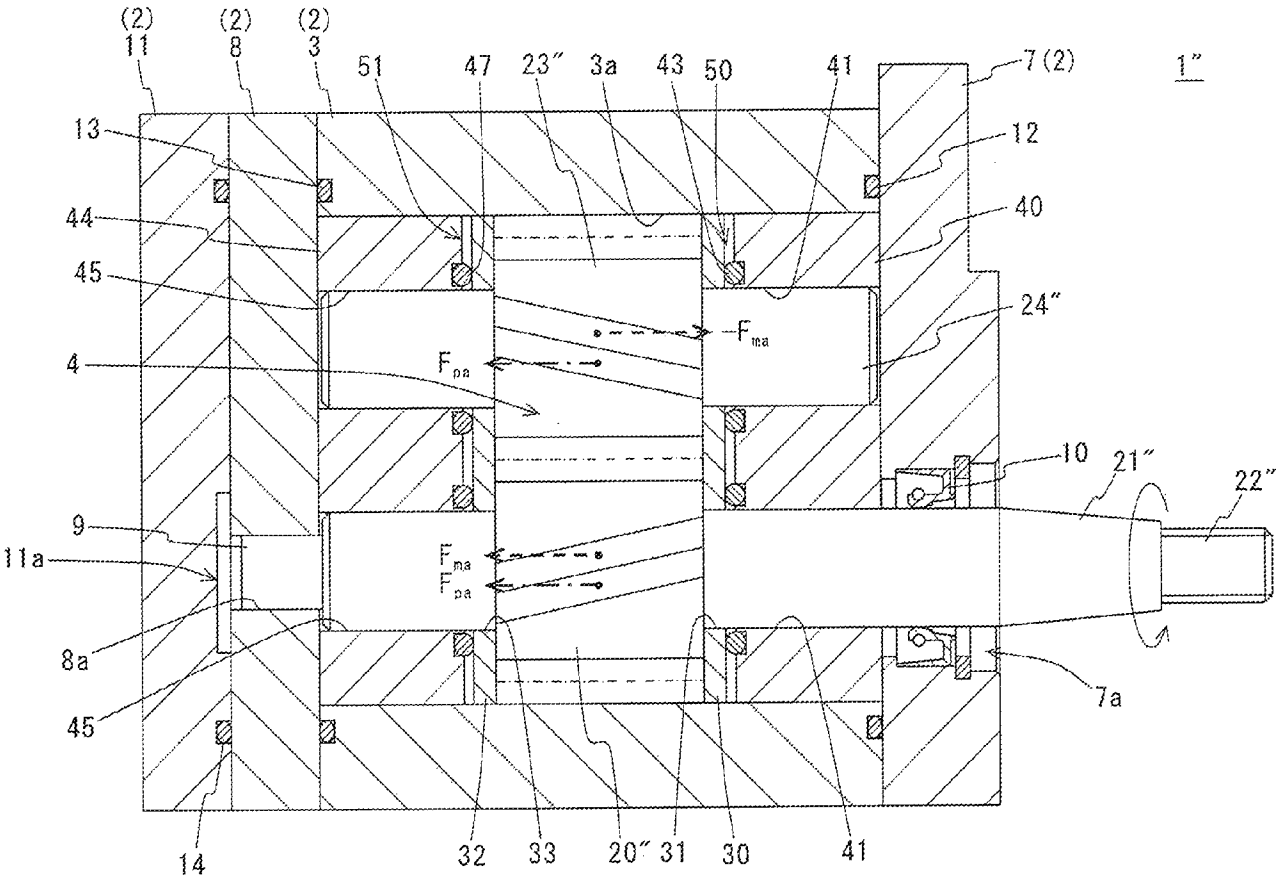
FIG. 16 is a plan sectional view of an oil hydraulic pump according to a further another embodiment of the present invention.
Figure 17:
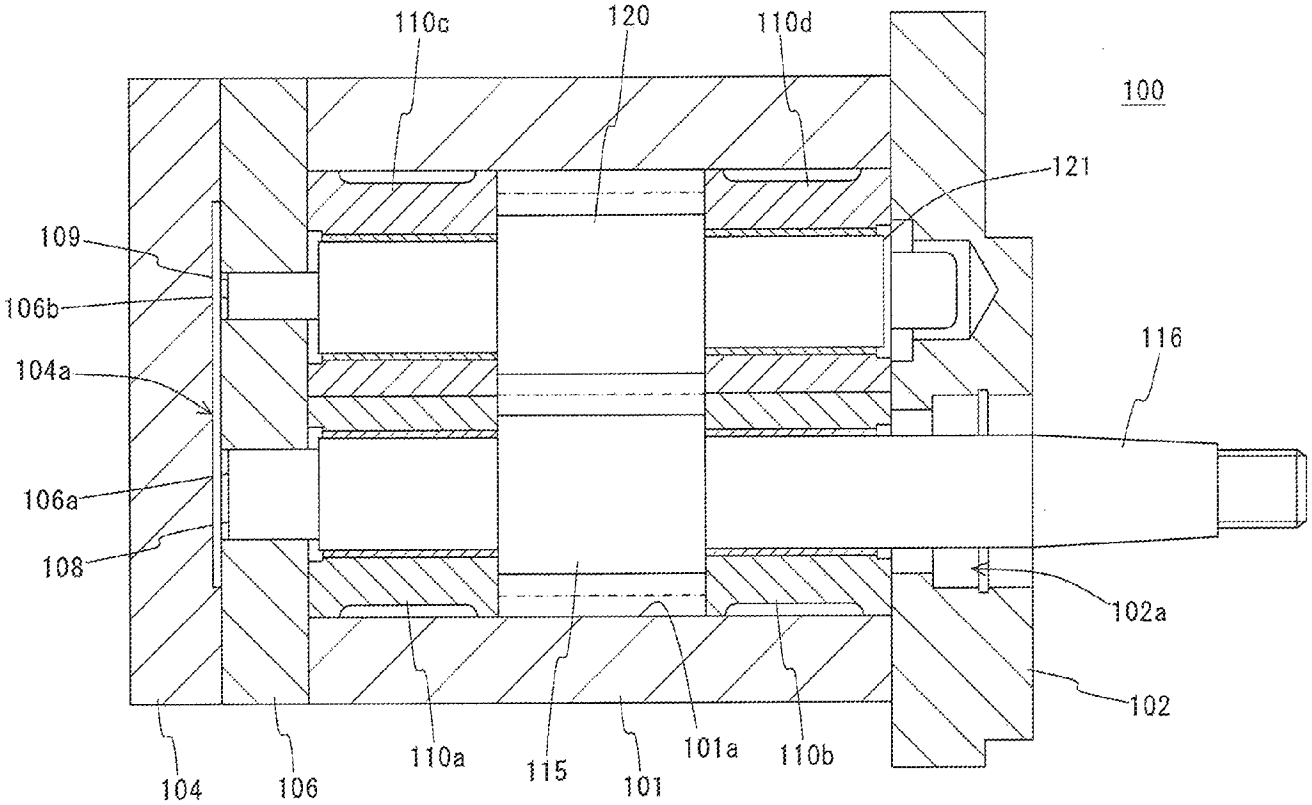
FIG. 17 PRIOR ART
FIG. 17 is a plan sectional view of a conventional gear pump.

Further, although, in the oil hydraulic pump 1 of the above-described embodiment, a right-handed helical gear is used as the driving gear 20 and a left-handed helical gear is used as the driven gear 23, there may be an oil hydraulic pump 1" using a left-handed helical gear as a driving gear 20" and a right-handed helical gear as a driven gear 23", as shown in FIG. 16. In this case, the driving gear 20" is rotated in the direction indicated by the arrow in FIG. 16.

Also in the oil hydraulic pump 1" having this configuration, a state where both of the gears 20", 23" do not receive a thrust-directional force can be achieved and the conventional problem that seizure or damage due to a thrust force occurs on the side plates 30, 32 which are in sliding contact with the gears 20", 23 is not caused.

It is noted that, also in FIG. 16, the same components as those of the oil hydraulic pump 1 shown in FIGS. 1 to 4 are indicated by the same references.

Further, although in the foregoing, the embodiment in which the hydraulic device of the present invention is embodied as an oil hydraulic pump is shown as an example, the hydraulic device of the present invention is not limited thereto and may be embodied as an oil hydraulic motor, for example. Further, the working liquid is not limited to a hydraulic oil and coolant may be used as the working liquid, for example. In this case, the hydraulic device of the present invention is embodied as a coolant pump.

Further, although not particularly mentioned in the foregoing, a configuration is possible in which a key groove is formed in the tapered portion of the rotating shaft 21 and a key is inserted into the key groove and an appropriate rotary body may be coupled to the tapered portion of the rotating shaft 21 by the key groove and the key.

Further, although, in the above embodiment, the intake port 5 and the discharge port 6 are formed as through holes on the body 3, they may be anything as long as they lead to the hydraulic chamber 4, and therefore, the intake port 5 and the discharge port 6 may be formed on the body and the front cover 7 and/or the end cover 11 to form flow paths (an intake flow path and a discharge flow path) one ends of which lead to the hydraulic chamber 4 though an opening formed in the body 3 and the other ends of which lead to the outside through an opening formed in the front cover 7 and/or the end cover 11.

Furthermore the "continuous-line-of-contact meshing gear" includes an involute gear, a sine-curve gear, a segmental gear, a parabola gear, etc.

The invention claimed is:

1. A hydraulic device at least comprising:

a pair of helical gears which each have a rotating shaft provided to extend outward from both end surfaces thereof, and whose tooth portions mesh with each other, the pair of helical gears having a tooth profile including an arc portion at a tooth tip and a tooth root, and forming a continuous line of contact from one end portion to the other end portion in a face width direction at a meshing portion;

a body open at both ends and having a hydraulic chamber therein in which the pair of gears are contained in a state of meshing with each other, the hydraulic chamber having an arc-shaped inner peripheral surface with which outer surfaces of the tooth tips of the gears are in sliding contact;

a pair of bearing members which are respectively disposed on both sides of the gears in the hydraulic chamber of the body and which support the rotating shafts of the gears so that the rotating shafts are rotatable;

a pair of cover plates which are respectively liquid-tightly fixed to both end surfaces of the body to seal the hydraulic chamber, the hydraulic chamber having a low-pressure side defined on one side of the meshing portion of the pair of gears and a high-pressure side defined at the other side thereof; and the body having a flow path which opens into an inner surface of the low pressure side of the hydraulic chamber and a flow path which opens into the inner surface of the high pressure side of the hydraulic chamber, wherein one of the pair of cover plates which faces a shaft end surface of a thrust-force acting side of the rotating shaft of one of the gears which receives a thrust force due to a working liquid in the high-pressure side and a thrust force due to the meshing from the same direction has a cylinder hole formed at a portion opposite to said shaft end surface, a flow path for supplying the working liquid in the high-pressure side into the cylinder hole is formed, a piston is disposed in the cylinder hole to be capable of being brought into contact with the shaft end surface opposite to the cylinder hole, and the working liquid in the high-pressure side is configured to act on a back surface of the piston to press the piston onto the shaft end surface, thereby causing a drag balancing a resultant force of the two thrust forces to act on the shaft end surface, and on the other hand the one of the pair of cover plates does not have a cylinder hole formed at a portion opposite to a shaft end surface of the rotating shaft of the other of the pair of gears, and the pair of helical gears have a tooth profile fulfilling a condition that a ratio of contact ratios $\epsilon r(=\epsilon\beta/\epsilon\alpha)$ which is a ratio of overlap ratio $\epsilon\beta$ to transverse contact ratio $\epsilon\alpha$ is $2<=\epsilon r<=3$.

2. The hydraulic device according to claim 1, wherein the hydraulic device has seal members with elasticity respectively interposed between facing surfaces of the pair of cover plates, which face the pair of bearing members, and facing surfaces of the pair of bearing members, which face the pair of cover plates, and dividing spaces between the facing surfaces of the pair of cover plates and the facing surfaces of the pair of the bearing members, the pair of bearing members are disposed to be in contact with the end surfaces of the gears and the working liquid in the high-pressure side is supplied into the spaces divided by the seal members between the facing surfaces of the pair of cover plates and the facing surfaces of the pair of bearing members, and the pair of gears and the pair of bearing members are configured to be movable in axial directions of the rotating shafts by elastic deformation of the seal members.

3. The hydraulic device according to claim 1, wherein the hydraulic device has a pair of side plates which are respectively interposed between the pair of gears and the pair of bearing members and which are disposed to be in contact with the end surfaces of the gears, and seal members with elasticity respectively interposed between the pair of side plates and the pair of bearing members to divide spaces between facing surfaces of the pair of side plates, which face the pair of bearing members, and facing surfaces of the pair of bearing members, which face the pair of side plates, the working liquid in the high-pressure side is supplied into the spaces divided by the seal members between the facing surfaces of the pair of side plates and the facing surfaces of the pair of bearing members, and the pair of gears and the pair of side plates are configured to be movable in axial directions of the rotating shafts by elastic deformation of the seal members.

4. The hydraulic device according to claim 1, wherein the magnitude of the drag caused to act on the shaft end surface is set to be within a range of 0.9 to 1.1 times of the resultant force of the two thrust forces.

* * * * *